United States Patent [19]

Bernstein

[11] 4,122,382

[45] Oct. 24, 1978

[54] LOAD-RESPONSIVE TREATER CONTROLLER

[75] Inventor: John L. Bernstein, Palo Alto, Calif.

[73] Assignee: Combustion Engineering, Inc., Windsor, Conn.

[21] Appl. No.: 789,042

[22] Filed: Apr. 20, 1977

[51] Int. Cl.[2] ..... G05F 1/30

[52] U.S. Cl. ..... 323/4; 307/351; 323/18; 323/45

[58] Field of Search ..... 323/4, 18, 22 SC, 24, 323/45; 307/252 UA, 228, 351

[56] References Cited

U.S. PATENT DOCUMENTS

| | | | |
|---|---|---|---|
| 3,532,855 | 10/1970 | Cleave | 323/24 X |
| 3,601,686 | 8/1971 | Gautherin | 323/24 X |
| 3,939,395 | 2/1976 | Prestridge et al. | 323/18 X |
| 4,038,594 | 7/1977 | Quinn et al. | 323/4 |
| 4,050,008 | 9/1977 | Glaser et al. | 323/18 X |
| 4,061,961 | 12/1977 | Baker | 323/4 X |

*Primary Examiner*—A. D. Pellinen

*Attorney, Agent, or Firm*—Joseph H. Born; Richard H. Berneike

[57] ABSTRACT

Improved circuitry for regulating the average power supplied by an AC source to a load includes switching circuitry that the power applies to the load for integral numbers of full cycles of the AC source. Control of the circuit for switching the power on and off is accomplished by sensing and storing the peak current drawn by the load during the most recent application of power, reducing the stored quantity linearly with time, and causing another application of power wnen the stored quantity has dropped below a predetermined threshold.

8 Claims, 5 Drawing Figures

LOAD-RESPONSIVE TREATER CONTROLLER

BACKGROUND OF THE INVENTION

The present invention is in the field of regulating the average power applied to varying loads; particularly, this invention is applicable to oil-field treater equipment.

An example of the type of equipment in which the present invention finds it primary, though not exclusive, application is Prestridge, U.S. Pat. No. 3,772,180. The Prestridge apparatus is an oil treater that reduces the amount of water contained in oil. It applies an AC voltage across an interface in the vicinity of an oil-water emulsion. The amount of current that flows through the emulsion varies widely according to how much moisture is in the emulsion. As a result, the amount of power drawn by this load can swing to rather high levels when the moisture content of the emulsion is high. If the average power applied to the load remains high, damage can be done to the treater equipment. Accordingly, it is necessary to regulate the power applied to the load.

Another patent issued to Prestridge, U.S. Pat. No. 3,939,395, discloses a circuit for regulating the average power applied to the load. Basically, the apparatus in the U.S. the No. 3,939,395 patent senses te AC current flowing through the load, rectifies and filters the representation produced by the sensing, and uses the result as an indication of whether or not to remove the power from the load. As long as this resultant filtered signal remains above a predetermined level, the power remains removed from the load. When the filter signal falls below the predetermined level, the apparatus reconnects the AC source at a zero crossing of the voltage, thereby avoiding high-voltage transients in the transformer. Because the filtered signal is at a high value immediately after a large current has flowed through the load, the power is disconnected for some period of time until the voltage in the filter circuit has decayed below the predetermined level. If the current is relatively high, it takes a relatively long time for the voltage in the filter circuit to decay, thereby decreasing the duty cycle of the application of power to the load. If the current level is not quite so high, the duty cycle would be higher. If the current is low enough to allow continuous application of the source voltage without exceeding the average power, the voltage in the filter circuit would not be high enough to cause the power to be disconnected from the load, and the duty cycle is 100 percent. Thus, the average power level remains below that which would damage the treater apparatus.

While the apparatus of the U.S. Pat. No. 3,939,395 patent does act to protect the treater, there are two areas in which improvement can be effected. The first improvement involves the average power resulting from the regulating mechanism. Although the apparatus of the U.S. Pat. No. 3,939,395 patent keeps the average power below the danger level, different moisture levels in the emulsion result in different average powers when the connecting and disconnecting mechanisms are brought into play. Accordingly, there are ranges of operation in which the amount of power applied is decidedly less than the highest permissible level. Accordingly, a less-than-optimum level of treater action results. The second area open to improvement is in the maintenance of the apparatus; the SCR's used in the apparatus have a higher rate of malfunction than is desirable.

SUMMARY OF THE INVENTION

It is accordingly an object of the present invention to maximize treating action by keeping power applied at the maximum permitted level. It is another object of the present invention to increase the reliability of the electronic switches used in the power-regulating circuits.

The present invention is an apparatus for sensing the current applied to the load, storing the sensed current level, linearly reducing the stored level with time, and triggering the next application of power at the beginning of the first full cycle after the linearly reduced stored signal reaches a threshold dictated by the maximum power level permitted.

BRIEF DESCRIPTION OF THE DRAWINGS

These and further features and advantages of the invention become evident in the description of the embodiment shown in the drawings attached, wherein.

DETAILED DESCRIPTION OF THE PREFERRED EMBODIMENT

Figure 1:
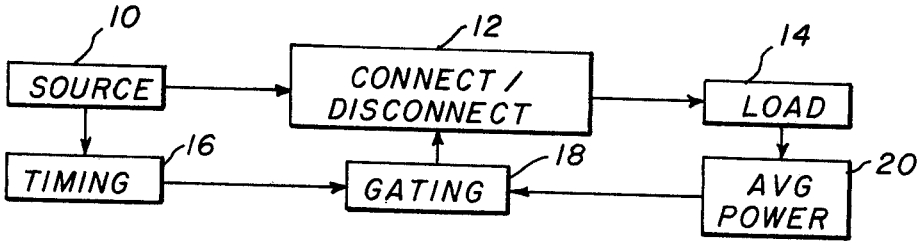
FIG. 1 is a block-diagram representation of the present invention.
Figure 2:
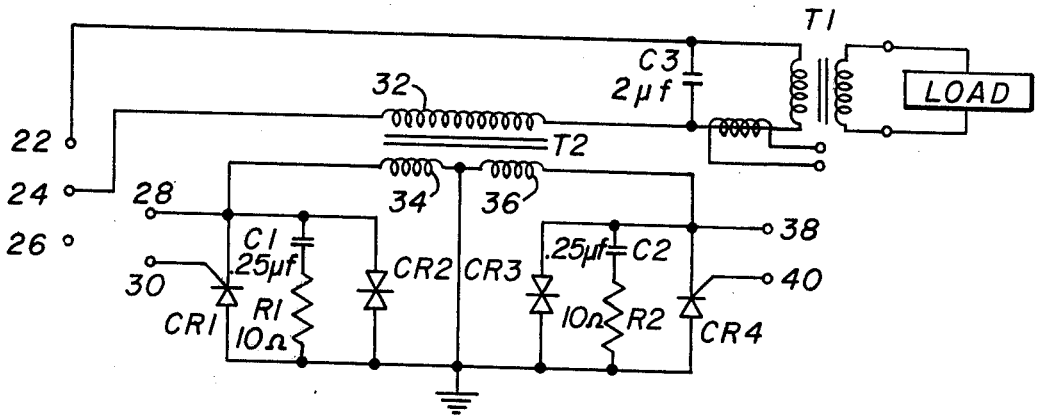
FIG. 2 is a schematic diagram of an embodiment of the power-connecting and disconnecting circuit of the present invention.

FIG. 1 is a drawing showing the interconnection of the parts of the preferred embodiment described in greater detail in later figures. Block 10 represents a source of AC power that will be shown as three-phase terminals in FIGS. 2, 3 and 5. Those skilled in the art will appreciate from the disclosure below that a single-phase source could also be used. Source 10 is selectively applied to a variable load 14 by connect-disconnect circuit 12, which is shown in FIG. 2. Gating circuit 18, which is shown in FIG. 5, controls connect-disconnect circuit 12 according to the information received from timing circuit 16, shown in FIG. 3, and average-power circuit 20, shown in FIG. 4. Timing circuit 16 monitors the phase of AC power source 10, while average-power circuit 20 monitors the amount of power applied to load 14. Given the information from timing circuit 16 and average-power circuit 20, gating circuit 18 can operate connect-disconnect circuit 12 at the beginning of the first full cycle of source 10 that occurs after it is determined that the average power has dipped low enough to permit another application of source 10 to load 14.

FIG. 2 shows the connect-disconnect circuit. Three-phase AC power is provided at terminals 22, 24 and 26. In the present embodiment, a three-phase source is used, but only the phase appearing across terminals 22 and 24 is applied to load transformer T1. The primary winding of transformer T2 is connected between terminal 24 and transformer T1. In the present embodiment, T2 is a high-voltage transformer that steps down the voltage at the primary, typically 480 volts AC, by one half. The secondary of T2 is center-tapped, thereby dividing it into two series-connected sets of windings 34 and 36. Silicon-controlled rectifier CR1 is connected across windings 34. It has a snubber circuit composed of R1 and C1 and a voltage clipper CR2 wired across it. The snubber circuit performs the conventional function of limiting dv/dt triggering of CR1, and it also stores enough energy to supply the turn-on current in CR1 until sufficient current builds up in the inductive load. Voltage clipper CR3 protects CR1 from over-voltage caused for example, by lightning. Terminals 28 and 30 provide triggering for the gate of CR1 at the appropriate times; the gating signals are received from the circuitry of FIG. 5.

In operation, a gating signal is introduced on lines 28 and 30 at the beginning of a full cycle of the AC source. That is, the gating signal is only introduced on a voltage-waveform zero crossing of a predetermined slope. Thus, if CR1 is triggered on the positive-going zero crossing of the voltage waveform, it will not be triggered on the negative-going zero crossing of the of the voltage waveform. (Actually, the triggering is slightly delayed from the zero crossing in order to provide sufficient holding current for the SCR's, but this may be ignored in the present discussion). Triggering of CR1 occurs at the beginning of every full cycle during the time when the power is to be applied to the load. CR1 is triggered, allowing current to flow in the circuit consisting of CR1 and windings 34, and this current tends to keep the magnetic flux in the core at a lower level, for a given primary current, than the level that would result if no current were flowing in the secondary. Consequently, the effective inductance seen by primary winding 32 is much lower than it is when no current is allowed to flow in secondary windings 34 and 36, so the voltage drop across winding 32 is much less. This allows the supply voltage to be applied to the load T1 instead of winding 32, and the treater operates. Since CR1 can only operate when the polarity is such that the left side of winding 34 is negative with respect to ground, CR4 is included to operate during those half cycles in which CR1 cannot operate. CR3, C2, R2, and CR4 operate in the same manner as CR2, C1, R1, and CR1, respectively. Terminals 38 and 40 bring in trigger signals from the circuit of FIG. 5, but the trigger signals brought in on terminals 38 and 40 are brought in 180° after the signals brought in on terminals 28 and 30. Thus, when it is determined that the source is to be connected to the load, CR1 and CR4 allow current to flow in the secondary of T2, reducing the inductance of primary 32 of T2 and allowing the voltage from terminals 22 and 24 to be applied to load T1. When it is determined that power is not to be applied to load T1, no gating signals are sent to CR1 or CR4, and current is thereby prevented from flowing in windings 34 and 36. This increases the inductance in primary 32 of T2 and prevents the voltage across terminals 22 and 24 from appearing across T1.

Capacitor C3 is included across terminals 22 and 24 to prevent ringing that may occur during heavy loads when diodes conduct that are connected to treater plates driven by the secondary of T1. It is to be noted that SCR's CR1 and CR4 are only indirectly connected to T1; they control the application of the voltage appearing at terminals 22 and 24 to the primary T1 by controlling the inductance of the primary T2. This is only an expedient for the purposes of this embodiment. There is no reason why the electronic switches could not be directly included in the line connecting the power to the primary of T1. However, as a practical matter, SCR's that can handle the smaller voltages appearing at the secondary of T2 are more readily available than those that can handle the higher voltages occurring across the primary of T2. In addition, had the SCR's been put directly in the three-phase line, it would have been necessary for their anodes, and consequently the heat sinks in which their anodes were mounted, to be at high voltages, and this would constitute a safety hazard. Thus, as a practical matter, indirect control of the application of the voltage to T1 is desirable. Nonetheless, it is to be emphasized that there is nothing in the essence of the invention that requires this arrangement.

Figure 3:
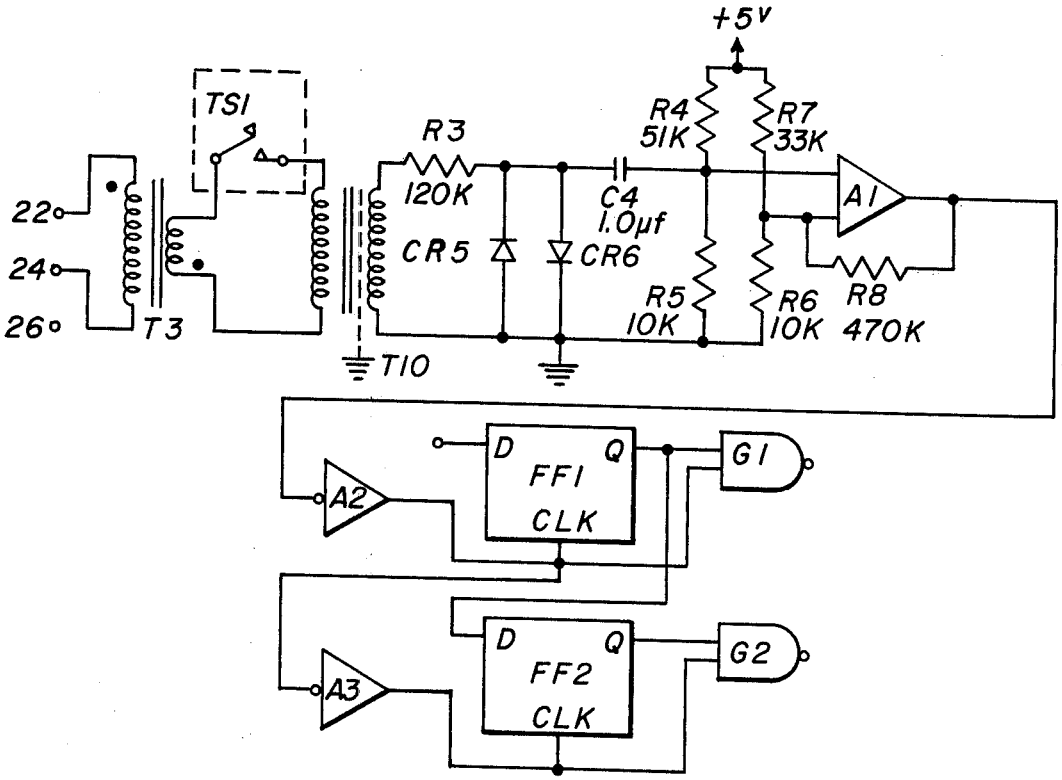
FIG. 3 is a schematic diagram of a timing circuit for use in the present invention.

FIG. 3 is a schematic of the circuit for providing the timing that insures that the source is connected to the load only for integral numbers of full cycles of the source voltage. Transformer T3 receives the 480-volt AC signal that appears across terminals 22 and 24 and reduces it to 120 volts. The output of T3 is connected through temperature-sensitive switch TS1 to transformer T10. T10 is electrostatically shielded and has a 1:1 ratio, and its purpose is merely to prevent common-mode noise from causing spurious triggering in parts of the circuit described below. The secondary of T10 is connected through resistor R3 to parallel diodes CR5 and CR6. CR5 and CR6 are parallel silicon diodes connected head to toe so that they clip the signal appearing to the left of R3 to $\pm 6/10$ of a volt with respect to ground. The resulting signal is AC coupled through C4 to the voltage-divider network consisting of R4 and R5, which maintain a DC component of approximately 1 volt at their junction. Thus, a signal varying from 0.4 volts to 1.6 volts appears at the negative input of differential amplifier A1. The signal at the negative input of amplifier A1 is compared with the DC level appearing at the junction of R7 and R6, which is approximately 1.2 volts. The difference is amplified in amplifier A1, and positive feedback through resistor R8 serves to drive the amplifier into saturation, causing a sharp response to level changes at the negative input. As a result, when the voltage at terminal 24 goes positive with respect to the voltage at terminal 22, amplifier A1 is driven strongly negative, resulting in an output near zero volts. When the voltage at terminal 24 goes negative with respect to terminal 22, amplifier A1 goes strongly positive, resulting in an output of around 5 volts. Accordingly, a square wave at the output of amplifier A1 is its response to a sine wave appearing at the left of R3.

The square wave appearing at the output of amplifier A1 is 180° out of phase with the signal appearing at terminal 24. But inverting amplifier A2 buffers the output of A1, enabling it to drive several loads, and brings the square wave back into phase with the sine wave at terminal 24.

The output of amplifier A2 drives the clock input of FF1, which is a D-type flip-flop. The D input of FF1 is driven by the average-power circuit of FIG. 4. The signal that drives the D terminal is an indication of whether it is time for another application of the source voltage to the load. If the D input is a logic "1", the meaning is that another application of the source voltage to the load can be permitted. In response to the logic "1" at the D input terminal, the Q output goes to a logic "1" on the positive leading edge of the square wave appearing at the clock terminal of FF1. Thus, if it has been determined that power is to be applied to the load, the Q output of FF1 goes to logic "1" when the voltage at terminal 24 goes through zero in a positive direction. If it has been determined that it is necessary for the source voltage to be disconnected from the load, the input at the D terminal becomes a logic "0" and a logic "0" therefore appears at the Q output terminal at the next positive leading edge of the square wave occurring at the clock input of FF1. Accordingly, the output of FF1 only changes on the positive leading edge of the square wave produced by A2, and this leading edge occurs at the same time as the positive-going zero crossing of the voltage at terminal 24. The Q output of FF1 is NANDed in gate G1 with the output of amplifier A2. The output of NAND gate G1 is therefore a logic "1" when the Q output of FF1 is a logic "0," and it is a square wave 180° out of phase with the output of amplifier A2 when the Q output of FF1 is a logic "1."

The output of amplifier A2 is also sent to the input terminal of inverting amplifier A3, whose output is fed to the clock input terminal of FF2, a D-type flip flop. The D input of FF2 is the Q output of FF1. Since the clock input of FF2 is thus 180° out of phase with the clock input of FF1, the FF2 output is the output of FF1 delayed by 180°.

The overall function of the circuit of FIG. 3 can now be appreciated. Assuming that the D input of FF1 has been at a logic "0" for some time—that is, assuming that it has been determined that the power was to remain disconnected from the load for some time—the output of G1 and G2 will both have been at a logic "1" for a period of several cycles of the source voltage. If the input to FF1 suddenly goes to a logic "1," meaning that it is now desired to connect the source to the load, the output of G1 will go to a logic "0" at the next positive-sloped zero crossing of the voltage at terminal 24. This will be the start of a square wave having the frequency of the source voltage. At the first negative-sloped zero crossing of the voltage at terminal 24 occurring after the first change of the output of G1, G2 will go to a logic "0," thus starting a square wave 180° behind the output of G1. If the D input to FF1 subsequently returns to a logic "0," thereby indicating that the source is to be disconnected from the load again, G1 will remain at a logic "1" at the next positive leading edge of A2, rather than changing its state to a logic "0" in accordance with the square-wave pattern it had theretofore been following. At the next leading edge of the A2 output, this one negative-going, the Q output of FF2 will go to "0," so G2 will remain in a logic "1" state instead of following the square wave. Thus, G1 and G2 will again be at a steady-state logic "1".

Figure 4:
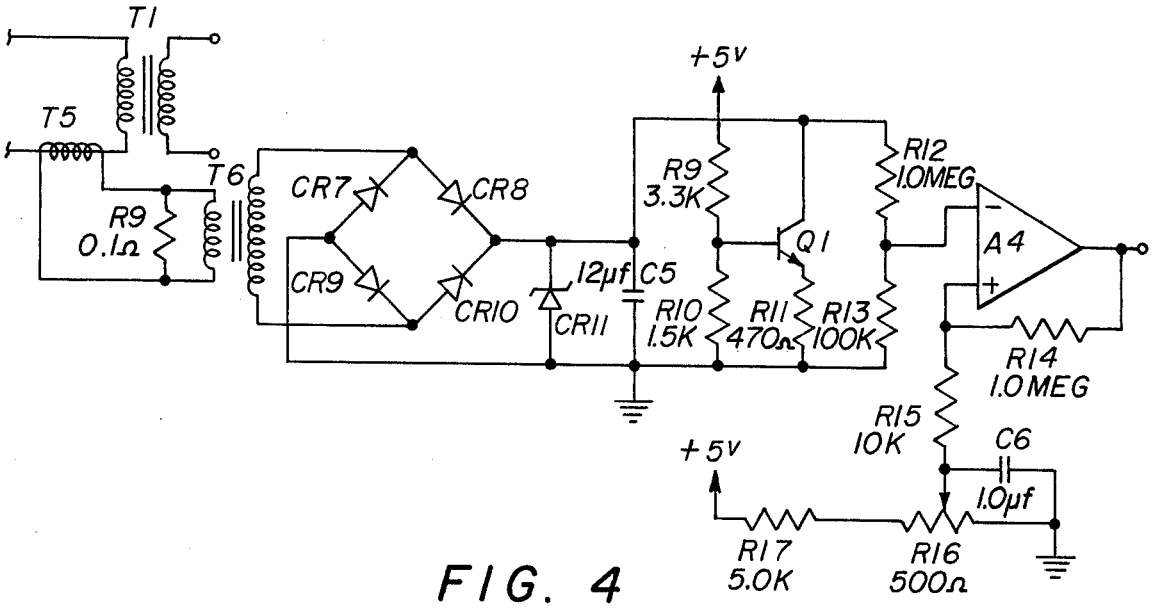
FIG. 4 is a schematic diagram of an average-power determining circuit for use in the present invention.
Figure 5:
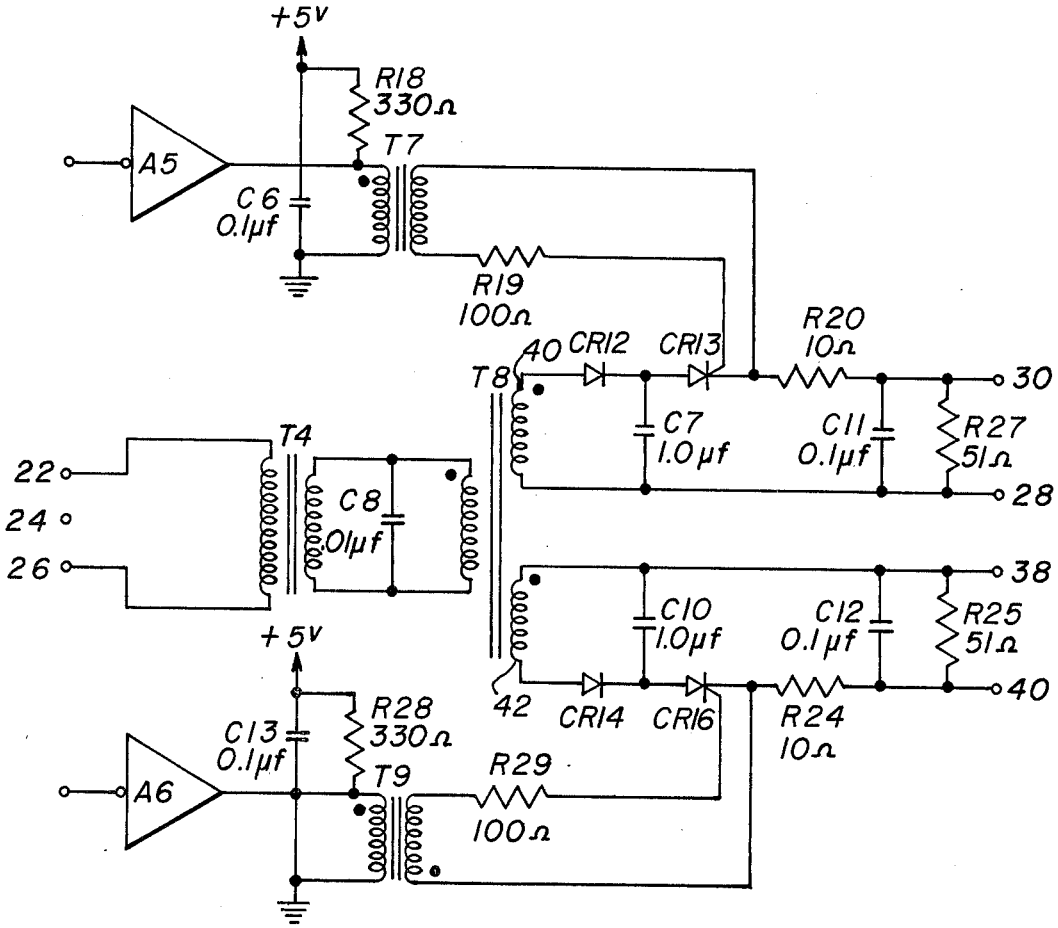
FIG. 5 is a schematic diagram of gating circuitry for use in the present invention.

FIG. 4 is a schematic diagram of the circuit that senses the current drawn by the load and determines whether the source and load should be connected. T5 is a current transformer that senses the current flowing from terminals 22 and 24 to the load. T5 drives R9, whose resistance is low in order to avoid interfering with the current-transformer action of T5. R9 has high accuracy and high stability in order to contribute to stable operation and accurate measurement of the current drawn by the load. If 160 amperes are flowing through the load, the current transformer, which in this case has 60:1 ratio, will cause 2.5 amperes to flow through R9, causing a ¼-volt AC signal to appear at the primary of T6. This voltage is stepped up to approximately 2.5 volts at the secondary of T6 and delivered to the bridge consisting of CR7, CR8, CR9, and CR10. The bridge rectifies the 2.5-volt AC signal appearing at the secondary of T6, and the rectified signal is stored on C5. CR11, a zener diode connected across C5, is merely a protective device, its zener voltage being much too high to clip the rectified signal delivered to C5. Since C5 can be charged, but not discharged, through the bridge, it can be seen that T5, C5, and all components between them constitute means for sensing and storing a signal representative of the peak current applied to the load.

As can be appreciated by those skilled in the art, the combination of R9, R10, R11, and Q1 constitutes a constant-current sink. The amount of current is determined by the voltage appearing at the junction of the voltage divider R9 and R10, the diode drop of the base-to-emitter junction of Q1, and the resistance of the emitter load R11. Since the conduction through R12 and R13, which are wired in series across C5, can be neglected, the result of the constant-current sink Q1 is decay of the voltage in C5 that is linear with time.

The voltage across C5 is divided by a voltage divider consisting of R12 and R13, and the result is delivered to the negative input terminal of A4, a differential amplifier. This input voltage is compared with a voltage generated by a 5-volt source and a voltage divider consisting of R16 and R17. Potentiometer R16 is adjusted according to the permitted power output of the apparatus to be controlled. Capacitor C6 is connected across this reference voltage set by R16 in order to filter out any noise that may appear at the voltage divider. When the voltage at the junction of R12 and R13, which is proportional to the voltage appearing across C5, falls below the voltage set by the voltage divider R16 and R17, amplifier A4 turns all the way on. This action is reinforced by the R14–R15 feedback network, which introduces positive feedback to the amplifier circuit. The purpose of the positive feedback is to cause sharp transitions and to introduce sufficient hysteresis to avoid indecision at the amplifier output. When the capacitor voltage is again high enough to cause the A4 negative input to go higher than the A4 positive input, the output of amplifier A4 will go all the way negative. Again, this is reinforced by positive feedback. The output of A4 is the input to the D terminal of FF1 of FIG. 3. The high output of A4 is a logic "1," that means that the source is to be connected to the load, while a low output of A4 is a logic "0," that means that the source is to be disconnected from the load.

When the effect of the previously mentioned hysteresis is considered, it is seen that the circuit of FIG. 5 and the components of FIG. 4 to the left of Q1 are means for causing the connection means (generally, FIG. 2) to connect the source to the load when the stored signal has fallen below a first predetermined level and for disconnecting the source from the load after the stored signal has exceeded a second predetermined level.

In order to appreciate the improvement afforded by the circuit of FIG. 4, it is necessary to follow its operation. If one assumes that the load is receiving the maximum power that is to be tolerated, which corresponds to a 160-ampere peak load current, then, ignoring diode drops in the bridge, it can be seen that approximately a 2.5-volt potential appears across C5 at the time the load current reaches its cyclical peak. This appears as a ¼-volt potential at the negative input of A4, and, since this is exactly the rated power level, a ¼ volt is the potential as set in by the R16, R17 voltage divider before it is connected to the A4 output. However, assuming that A4 had indicated previously that the source was to be connected to the load, the output of A4 would remain positive because the positive feedback would be added to the voltage-divider potential, causing a voltage higher than ¼ volt to appear at the positive input of A4.

Thus, there would be an indication that the source was to remain connected to the load.

Now assume that the peak current corresponds to a power consumption that is five times the rated power level. This means that 800 amperes are flowing through the load, and this causes a 12.5-volt potential to appear across C5. Accordingly, a 1.25-volt potential appears at the negative input of A4, causing its output to go to around 0 volts, indicating that the source is to be disconnected from the load. Immediately after the current peak, the voltage in C5 begins a linear decay caused by the constant-current action of Q1. Q1 draws approximately 1.9 milliamperes, which results in a linear voltage decay in 12-microfarad capacitor C5 of 2.5 volts every 60th of a second. Accordingly, it takes four full cycles of the source voltage for the potential difference across C5 to drop the 10 volts required to allow the output of A4 to go positive again, thereby reconnecting the source to the load. The source remains connected to the load for a full cycle, charging C5 to 12.5 volts again, and again the source is disconnected from the load. It can be seen that this results in an average power consumption that is right at the rated power level. The fact that the average power is right at the rated power level and not at some value below it is due to the fact that the voltage decay in C5 is linear with time and not an accidental function. The circuit of FIG. 4 therefore ensures that the optimum amount of treating action consistent with power limitations takes place in the treater.

FIG. 5 is a schematic diagram of the circuit that responds to the timing of FIG. 3 to gate the connecting circuit of FIG. 2 on and off. Terminals 26 and 22 supply a phase that is 120° ahead of the phase provided by terminals 24 and 22. This voltage is stepped down to approximately 120 volts AC by a transformer T4. C8 is wired across the secondary of T4 to short out whatever high-frequency noise may be in the source, and this filtered signal is applied to the primary of T8. T8 steps the 120-volt signal down to 10 volts in both secondaries 40 and 42 of T8. The signal in secondary 40 is rectified by CR12 and stored in capacitor C7.

Inverting amplifier A5 receives a square wave from NAND gate G1 of FIG. 3 that is 180° out of phase with the source voltage appearing between terminals 24 and 22. The output of A5 is therefore a square wave that is in phase with the voltage between terminals 24 and 22, and this output is applied to transformer T7. Capacitor C6, resistor R18, and a 5-volt source are provided in the circuit to appropriately load the amplifier and to filter the 5-volt source. T7 has only a small inductance, so it only passes the leading edge of the square wave to its secondary. This signal is used to current drive the gate of CR13 through R19. This positive pulse appearing at the gate of CR13 occurs 120° after the beginning of the charging half cycle of C7. Accordingly, C7 has charged to its peak, and the voltage appearing at secondary 40 of T8 has reached its half-power point, at the time that the gate signal is applied to the small SCR CR13. This immediately discharges C7 down to the voltage occurring at secondary 40 of T8, and C7 then follows the voltage at T8 down to zero. This discharging of the capacitor is accomplished through R20, which is a gate resistor for a larger SCR, CR1 of FIG. 2. The discharging of C7 causes a gate current of around one ampere in the gate of CR1, thereby causing it to turn on, reducing the inductance of the primary of T2 of FIG. 2, and allowing the source voltage to be applied to the load. Resistor R27 and capacitor C11 are provided as a snubber circuit for CR1, as is the common practice in the art.

CR16 is a small SCR whose purpose is to generate the gate pulse for CR4, which is the other SCR that shorts out the secondary of T2. In order for CR16 to fire at the appropriate time, it is necessary to have it fired on alternate half cycles from those on which CR13 is fired. The gating signal is therefore derived from the output of G2, which, as has been explained previously, provides a square wave 180° behind the square wave provided by G1. Accordingly, it can be seen that the circuit comprising A6, C13, R28, T9, R29, secondary 42, CR14, C10, CR16, R24, C12, and R25 provides the same function as the corresponding CR13 circuit, but the CR16 circuit operates during the half cycles in which CR13 does not operate.

The foregoing description therefore describes in detail the several elements of the disclosed embodiment of the invention. SCR's CR1 and CR4 and their associated circuitry, along with T1 and T2, constitute means for connecting and disconnecting the power source to the load. The circuits of FIGS. 3 and 5 together constitute means for causing the connecting means to connect the source to the load and disconnect the source from the load only the beginning of complete cycles of the AC source. Finally, the circuit of FIG. 4, in conjunction with FIGS. 3 and 5, constitutes a means for sensing and storing the peak value of the current drawn by the load, reducing the stored signal linearly with time, causing the connection means to connect the source to the load after the stored signal has fallen below a first predetermined level, and causing the connection means to disconnect the source from the load after the stored signal has exceeded a second predetermined level. Of course, many other realizations of the elements of this invention will be apparent to those skilled in the art. Most apparent, for instance, is one in which a single-phase is used, since a three-phase AC source is not needed for the present invention, because the triggering for the SCR's could easily have been generated without the third phase. It will also be apparent to those skilled in the art that it would be possible to utilize all three phases of three-phase source for delivering power to a load, and the average power could be controlled in essentially the same manner. Furthermore, it should be apparent to those skilled in the art that many of the components included in the embodiment disclosed could be eliminated and other components substituted for those that remain. All that is necessary is to retain the essential functions illustrated by the preferred embodiment.

It has been shown why the circuit of FIG. 4 is an improvement and how it ensures that maximum allowable treating action takes place. However, it has not been shown why the timing circuit of FIG. 3 accomplishes its objective of increasing the reliability of the SCR's used in switching the load in and out of the circuit. The following discussion is offered as a possible explanation as to why SCR reliability is increased by the use of the circuit.

The load in the type of application to which the present invention is directed is typically transformer coupled to the source of power. Since the power frequency is 60 Hz., iron-cored transformers are used. An iron-cored transformer magnetically couples an impedance to its primary that is proportional to the impedance of the secondary. In addition, there still remains an impedance in the primary due to the inductance of the transformer with the core if the secondary is shorted. This impedance limits the amount of current flowing through the transformer and ultimately the amount of current flowing through the electronic switches. If it has not been ensured that opposite cycles of the AC source will follow each other, then cycles of the same polarity can be sequentially applied to the iron core transformer. Since the core has already been magnetized in one direction by the preceding cycle, the next cycle does not cause a big change in the magnetic field, which means that the effective inductance seen by the second similar cycle is very low, and more current is permitted to flow in the transformer. Thus, a large amount of current flows through the electronic switch, possibly destroying it. Accordingly, if no provision has been made to ensure that only cycles of opposite polarity follow each other, there is a good chance that at some time several cycles of the same polarity will follow each other, each causing a current to flow through the switch that is limited only by the resistance of the windings and of the switch itself, and this could ultimately cause the switch to fail. Thus, if it is insured that only half cycles of alternate polarity follow each other, the reliability of the electronic switches is increased.

What is claimed is:

1. An apparatus for controlling the average amount of power applied by a source of AC power to a load comprising:

a. means connected between the source and the load for connecting and disconnecting the source to and from the load;

b. means for sensing the peak amount of current applied to the load and storing a signal representative of it;

c. means for reducing the stored signal linearly with time; and d. means for receiving the stored signal from the signal-storing means and causing the connection means to connect the source to the load when the stored signal is below a predetermined level.

2. An apparatus as recited in claim 1 wherein the means for causing the connection means to connect comprises a means for receiving the stored signal, causing the connection means to connect the source to the load at the beginning of the first complete cycle of the AC source after the stored signal has fallen below a first predetermined level, and disconnecting the source from the load at the beginning of the first complete cycle of the AC source after the stored signal has exceeded a second predetermined level.

3. An apparatus as recited in claim 2 wherein the connection means comprises:

a. primary windings magnetically coupled to the load and having first and second ends, the first end being connected to one side of the source voltage; and b. an electronic switch connected for operation by the means for causing the connection means to connect and arranged to control application of the source voltage to the primary windings.

4. An apparatus as recited in claim 3 further comprising a ferromagnetic core about which the primary windings are wound.

5. A method of controlling the average amount of power supplied by a source of AC power to a load, comprising the steps of:

a. sensing the peak amount of current applied to the load and storing a signal representative of it;

b. reducing the stored signal linearly with time; and c. connecting the source to the load after the signal has fallen below a first predetermined level and disconnecting the source from the load after the signal has exceeded a second predetermined level.

6. A method as recited in claim 5 wherein the source is connected to the load at the beginning of the first full cycle of the AC source voltage after the signal has fallen below the first predetermined level and disconnected from the load at the beginning of the first full cycle of the AC source after the signal has exceeded the second predetermined level.

7. A method as recited in claim 6 wherein the source is connected to the load by applying the source voltage to a set of primary windings magnetically coupled to the load.

8. A method as recited in claim 7 wherein the primary windings are magnetically coupled to the load by means of a ferromagnetic core.

* * * * *